US006475430B1

(12) United States Patent
Nagata et al.

(10) Patent No.: US 6,475,430 B1
(45) Date of Patent: Nov. 5, 2002

(54) METHOD AND APPARATUS FOR PACKING MATERIAL INCLUDING AIR TAPPING

(75) Inventors: Hiroshi Nagata; Masato Sagawa, both of Kyoto (JP)

(73) Assignee: Intermetallics Co., Ltd., Kyoto (JP)

( * ) Notice: Subject to any disclaimer, the term of this patent is extended or adjusted under 35 U.S.C. 154(b) by 6 days.

(21) Appl. No.: 09/656,373

(22) Filed: Sep. 6, 2000

Related U.S. Application Data

(63) Continuation-in-part of application No. 09/474,813, filed on Dec. 29, 1999, now abandoned, and a continuation-in-part of application No. 09/404,229, filed on Sep. 23, 1999, now abandoned.

(30) Foreign Application Priority Data

Sep. 24, 1998 (JP) ..... 10-269273
Sep. 7, 1999 (JP) ..... 11-252766

(51) Int. Cl.[7] ..... B22F 3/10
(52) U.S. Cl. ..... 419/38; 222/197
(58) Field of Search ..... 419/38; 222/197

(56) References Cited

U.S. PATENT DOCUMENTS 2,042,635 A * 6/1936 Schellens ..... 75/135
2,227,308 A * 12/1940 Hildabolt ..... 75/22
4,788,254 A * 11/1988 Kawakubo et al. ..... 525/100
5,250,255 A * 10/1993 Sagawa et al. ..... 419/39
5,725,816 A * 3/1998 Sagawa et al. ..... 264/102
6,051,324 A * 4/2000 Morrhead et al. ..... 428/552

* cited by examiner

*Primary Examiner*—Daniel J. Jenkins
(74) *Attorney, Agent, or Firm*—Morrison & Foerster LLP

(57) ABSTRACT

The present invention relates to a packing method and an apparatuses implementing said method in which a material is packed into a container by an air tapping process in which the air-pressure state of the space comprising a container and a space part connected with said container, which space being loaded with the material, is switched several times from a low air-pressure state to a high air-pressure state alternately, while keeping said low air-pressure state equal to or higher than the atmospheric pressure existing outside said space, thereby preventing the material from getting blown up by the inflow of the atmospheric air outside the container and packing a material into said container homogeneously.

5 Claims, 7 Drawing Sheets

METHOD AND APPARATUS FOR PACKING MATERIAL INCLUDING AIR TAPPING

REFERENCE TO RELATED APPLICATIONS

This application is a continuation-in-part of Ser. No. 09/404,229, filed Sep. 23, 1999, now abandoned and of Ser. No. 09/474,813 now abandoned, filed Dec. 29, 1999.

FIELD OF THE INVENTION

The present invention relates to a packing method and a packing apparatus in which a powder, a granular material, a material in flakes, a plate material or the like (hereinafter collectively referred to as the "material") is injected into a container or receptacle such as a can, a bag, a rubber mold, a die or the like (hereinafter collectively referred to as the "container") which has an opening for feeding the material and a space of which is filled with said powder or the like.

BACKGROUND OF THE INVENTION

Japanese patent applications commonly assigned with this application and published as KOKAI H9-78103, KOKAI H9-169301, and KOKAI H11-49101, and in commonly assigned U.S. Pat. No. 5,725,816 disclose packing a container, a can, a bag, a rubber mold, a die or the like with a material by using an air-tapping method.

By adopting said air packing method, scattering in quantity of the material at each time of the filling has been decreased, and the regional difference in packing density of the material in the container has been lessened.

Referring to FIGS. 5, 6, and 7, this earlier disclosed air packing methods are hereinafter described. Here, a die and a punch inserted into said die form a container into which a powder is injected.

A part (1) shown in FIG. 5 is a cylindrical die, and part (2) is a punch inserted into the die (1) (hereinafter this punch is referred to as the "lower punch"). A powder is to be filled into a die cavity (3) which is a space formed with the die (1) and the lower punch (2). A table (4) is arranged so that its upper surface is flush with the upper surface (1*a*) of the die (1). A box-shaped, bottomless feeding element (hereinafter referred to as the "feed shoe") (5) is mounted on the table (4). The external wall of the receded part of the feed shoe (5) is provided with a pipe (6), which is connected to an aspirator-type vacuum generator (7). A pipe (8) connected to the external wall (5*a*) of the feed shoe (5) is connected to a compressed air supplier (10) through an electromagnetic valve (9). A part (11) is a cover attached to the upper opening of the part (5*a*) of the feed shoe (5). The feed shoe (5) is loaded with a powder (p). A horizontal cylinder (12) is attached to the table (4), and a piston rod (12*a*) attached to the horizontal cylinder is connected to the feed shoe (5).

In order to fill the die cavity (3), which is formed with the die (1) and the lower punch (2) inserted into said die (1), with the powder (p), the feed shoe (5) mounted on the table (4) is moved by driving the horizontal cylinder (12) so as to move the piston rod (12*a*) until the feed shoe (5) is located above the die cavity (3) as shown in FIG. 6. Then, the powder (5) stored in the feed shoe (5) falls into the die cavity (3).

Subsequently, the aspirator-type vacuum generator (7) is energized with the electromagnetic valve (9) being closed so that air in the feed shoe (5) is let out, thereby changing the air-pressure inside the feed shoe (5) from the atomospheric state (a) to a state lower than the atmospheric pressure (b). FIG. 7 shows an example in which the lower state (b) is 0.5 atm. Then, by stopping deaeration by the aspirator-type vacuum generator (7) and opening the electromagnetic valve (9), the feed shoe (5) is supplied with compressed air from the compressed air supplier (10), and the air-pressure state inside the feed shoe (5) is brought into a state at least higher than the air-pressure state (b) described above. In FIG. 7, the air-pressure inside the feed shoe is brought into 0.8 atm, which is higher than the air-pressure state (b). When the air-pressure inside the feed shoe (5) has become higher than the air-pressure state (b) which is lower than the atmospheric pressure, the electromagnetic valve (9) is again closed and the aspirator-type vacuum generator (7) is energized so that the inside of the feed shoe (5) is brought into a state (b) lower than the atmospheric pressure. Subsequently, operation of the aspirator-type vacuum generator (7) is stopped and electromagnetic valve (9) is opened so that the inside of the feed shoe (5) is supplied with compressed air, thereby changing the state inside the feed shoe (5) from the air-pressure state (b) to a air-pressure state (c) higher than the air-pressure state (b).

As discussed above, by the air tapping method in which the air-pressure state inside the feed shoe is repeatedly switched from a state (b) which is lower than the atmospheric pressure to a state (c) which is higher than the state (b), the die cavity (3) formed with the die (1) and lower punch (2) inserted therein may be filled with the powder (p) homogeneously and highly densified. After the powder (p) is packed into the die cavity (3), the horizontal cylinder (12) is moved so as to retract the piston rod (12*a*), thereby relocating the feed shoe (5) away from the die cavity (3). Then, an upper punch (not shown in the Figure) is inserted into the die (1) and lowered to press the powder (p) packed in the die cavity (3) so as to obtain a powder compact.

SUMMARY OF THE INVENTION

The earlier methods in which filling is carried out not by air tapping but only by gravity suffer problems that: the packing quantity varies at each time of packing, the packing density varies regionally in the container, and the packing quantity of each container is uneven when filling multiple containers at the same time. In particular, when a cavity with a complex shape or with a shallow ring shape is filled with a powder by the filling methods without the use of air tapping, the unevenness of the packing density in the cavity greatly deteriorates the quality of the product.

By adopting air tapping to fill a container with a material, the problems as described above may be prevented. However, in the earlier air tapping method and apparatuses described above, air tapping is carried out by the repetition of switching the air-pressure state from a state (b), which is lower than the atmospheric pressure, to a state (c), which is higher than the state (b), a problem arises when the air-pressure inside the feed shoe (5) becomes lower than the atmospheric pressure. That is, the air outside the die cavity (3) flows into the die cavity (3) through the clearance between the internal wall (1*b*) of the die (1) and the external wall (2*a*) of the lower punch (2), which blows up the powder (p) packed in the die cavity (3).

In addition, when the earlier air tapping method is used for filling a rubber mold (17) shown in FIG. 3 with a powder, since the air-pressure state inside the rubber mold (17) becomes lower than the atmospheric pressure when it is at the low air-pressure state in the air tapping process, it is necessary to prevent the rubber mold from deforming inwardly by resorting to means for bringing the outside of the rubber mold also into a low air-pressure state. Such a preventive measure complicates the structure of the apparatus, causing the apparatus to be costly and trouble prone.

It is an object of the present invention to solve the problems that the earlier packing methods and apparatuses suffered.

DETAILED DESCRIPTION OF THE INVENTION

In order to achieve the above discussed object, the present inventors devised a new packing method in which air tapping is carried out by switching the air-pressure state of a space comprising a container and a space part connected with said container from a low air-pressure state to a high air-pressure state several times while keeping said low air-pressure state equal to or higher than the atmospheric pressure outside said space, as well as an apparatus comprising a means for bringing the air-pressure state of said space into an air-pressure state which is higher than the atmospheric pressure outside said space, and a means for bringing the space that has been at an air-pressure state higher than the atmospheric pressure into an air-pressure state lower than said state but equal to or higher than the atmospheric pressure outside said space.

Using FIGS. 1 to 7, embodiments of the present invention will be discussed, but the present invention is not limited to these embodiments but may be otherwise modified within the scope of the invention.

Figure 1:
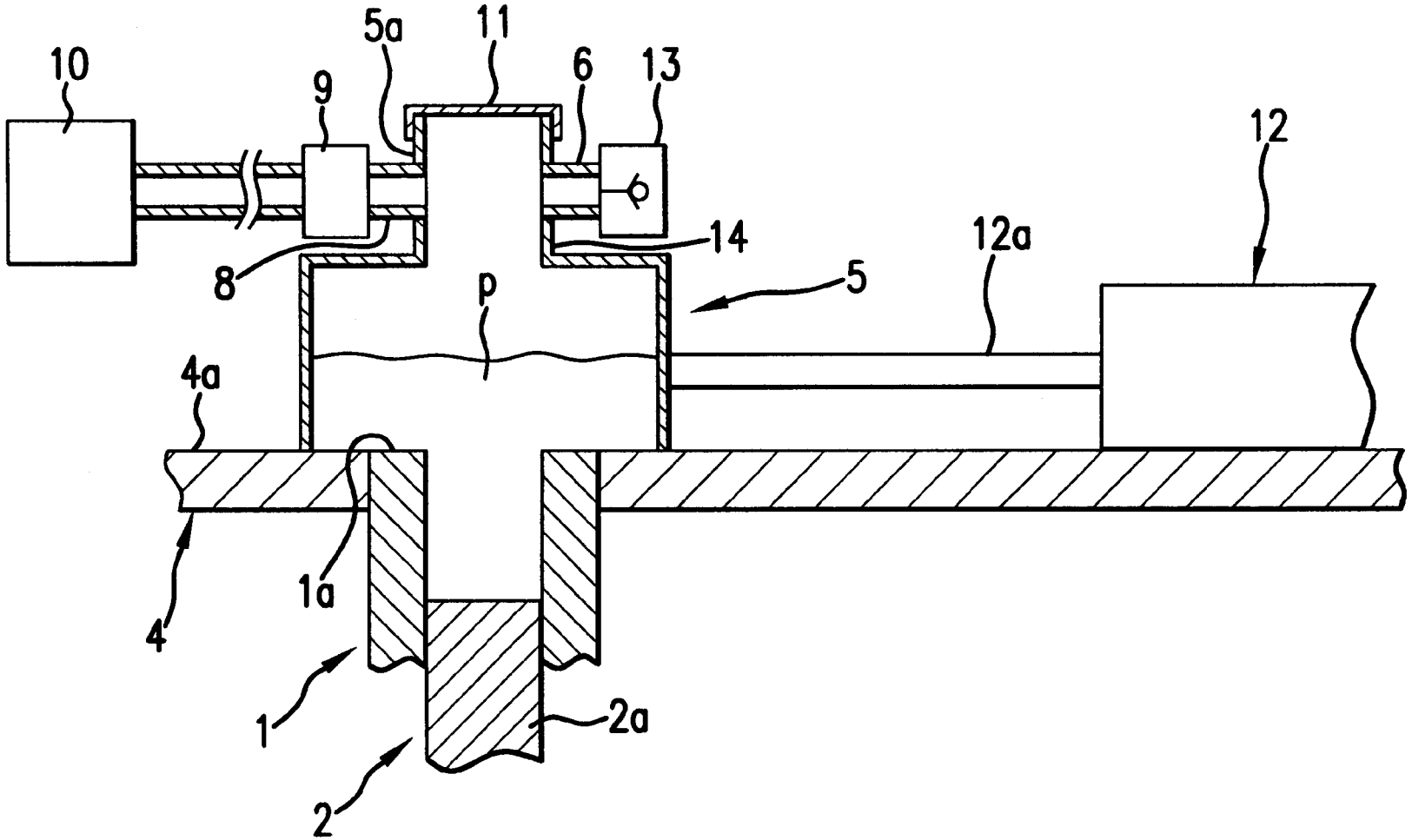
FIG. 1 is a vertical sectional view of a packing apparatus embodying the present invention.
Figure 2:
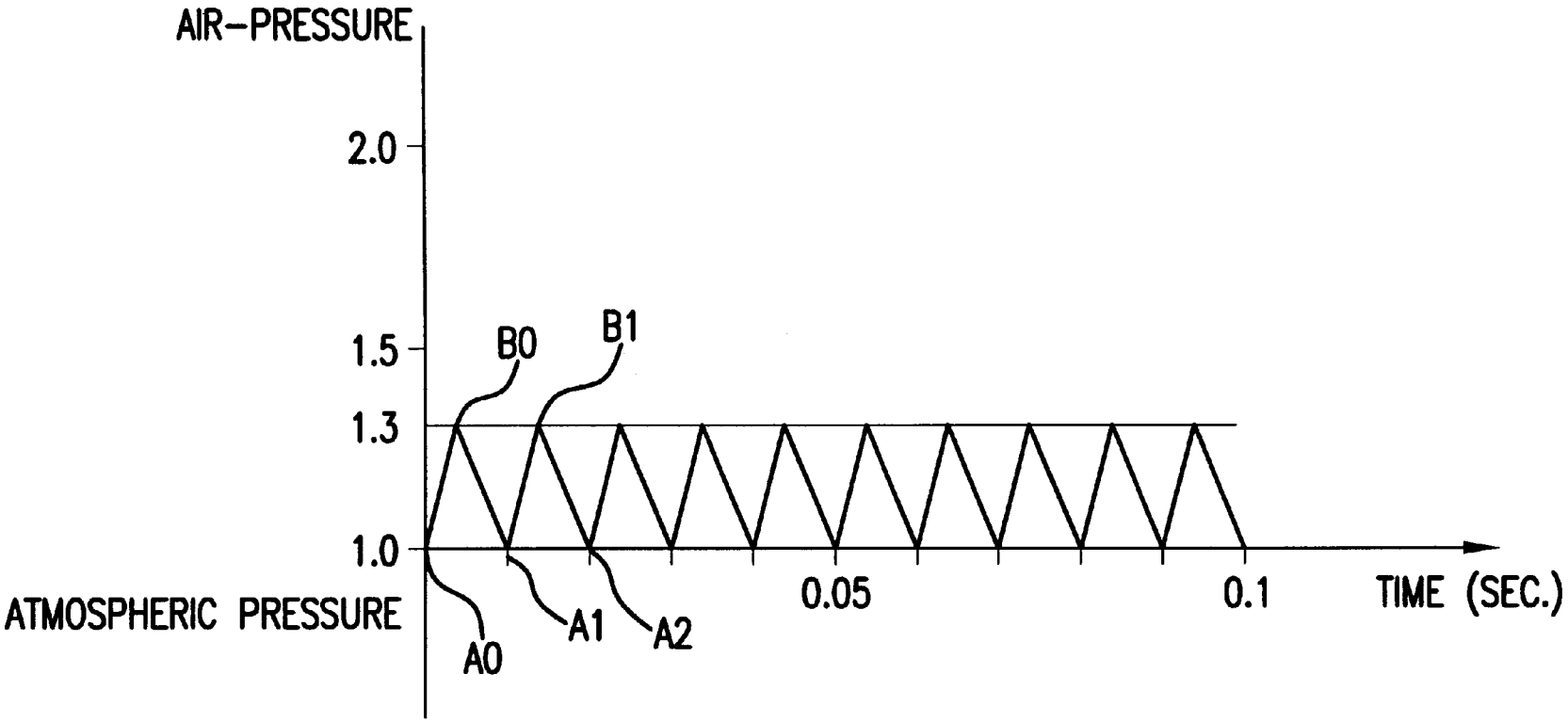
FIG. 2 is an operational diagram showing switching of the air-pressure when the air tapping of the present invention is applied.

First of all, using FIGS. 1 and 2, an embodiment is explained in which a powder to be compacted is packed into a die cavity as a space to be packed. Detailed description of the parts that correspond to those in the earlier packing apparatus described above will be omitted and indicated by the same numerals.

Similarly to the earlier packing apparatus described above, a pipe (8) attached to the external wall of the receded part **(5*a*) of the feed shoe (5) is connected to a compressed air supplier (10) through an electromagnetic valve (9). The part (13) is a pressure-releasing valve that is attached to a pipe (6) connected to the external wall of the receded part (5*a*) of the feed shoe (5). The pressure-releasing valve (13) is designed to exhaust the air inside the feed shoe (5) when the air-pressure inside the feed shoe (5) becomes higher than a certain degree that is higher than the atmospheric pressure. An air-releasing hole (14) is formed in the wall of the receded part (5*a*) of the feed shoe (5)**.

Figure 6:
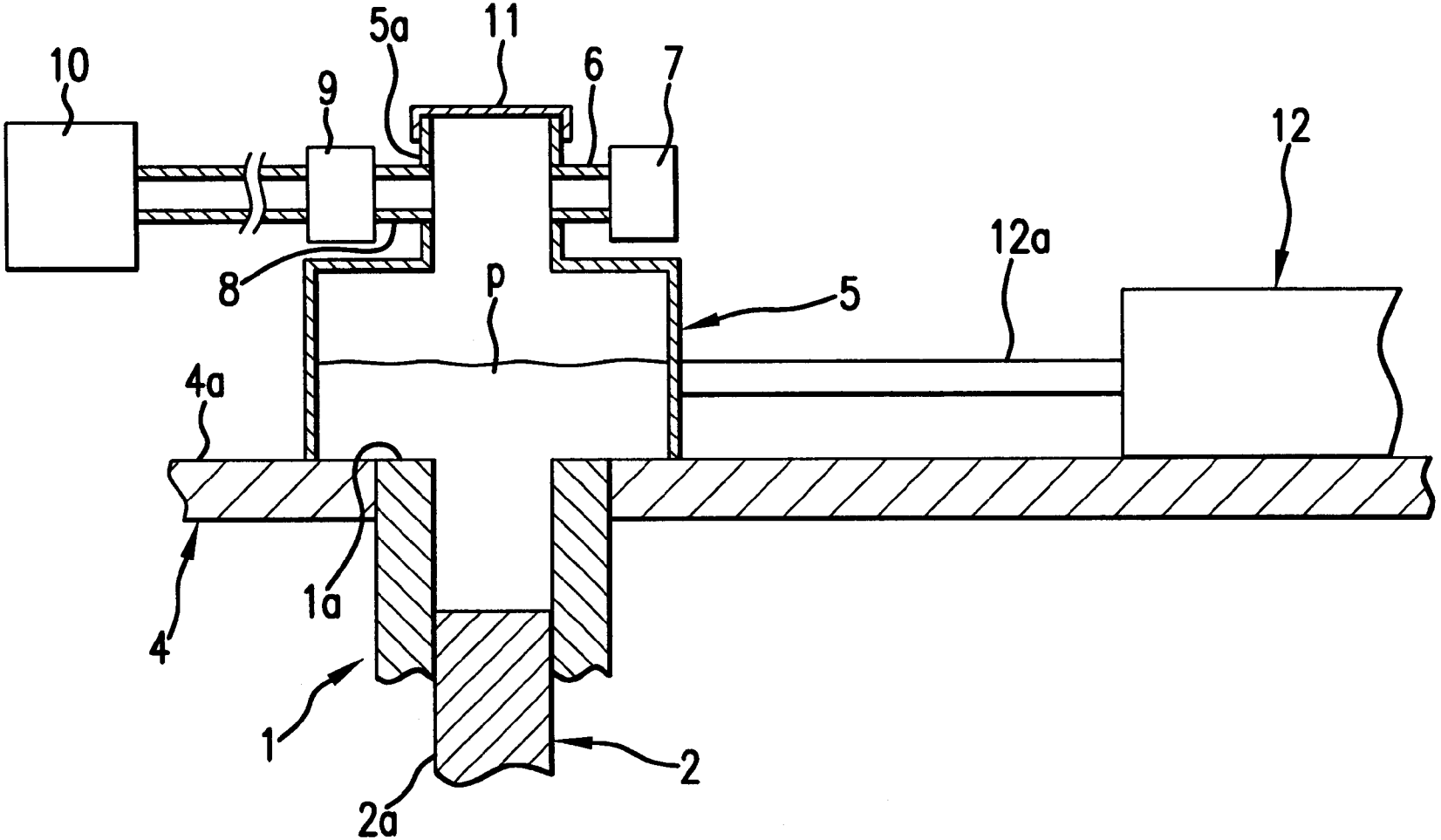
FIG. 6 is a vertical sectional view of another earlier packing apparatus.
Figure 7:
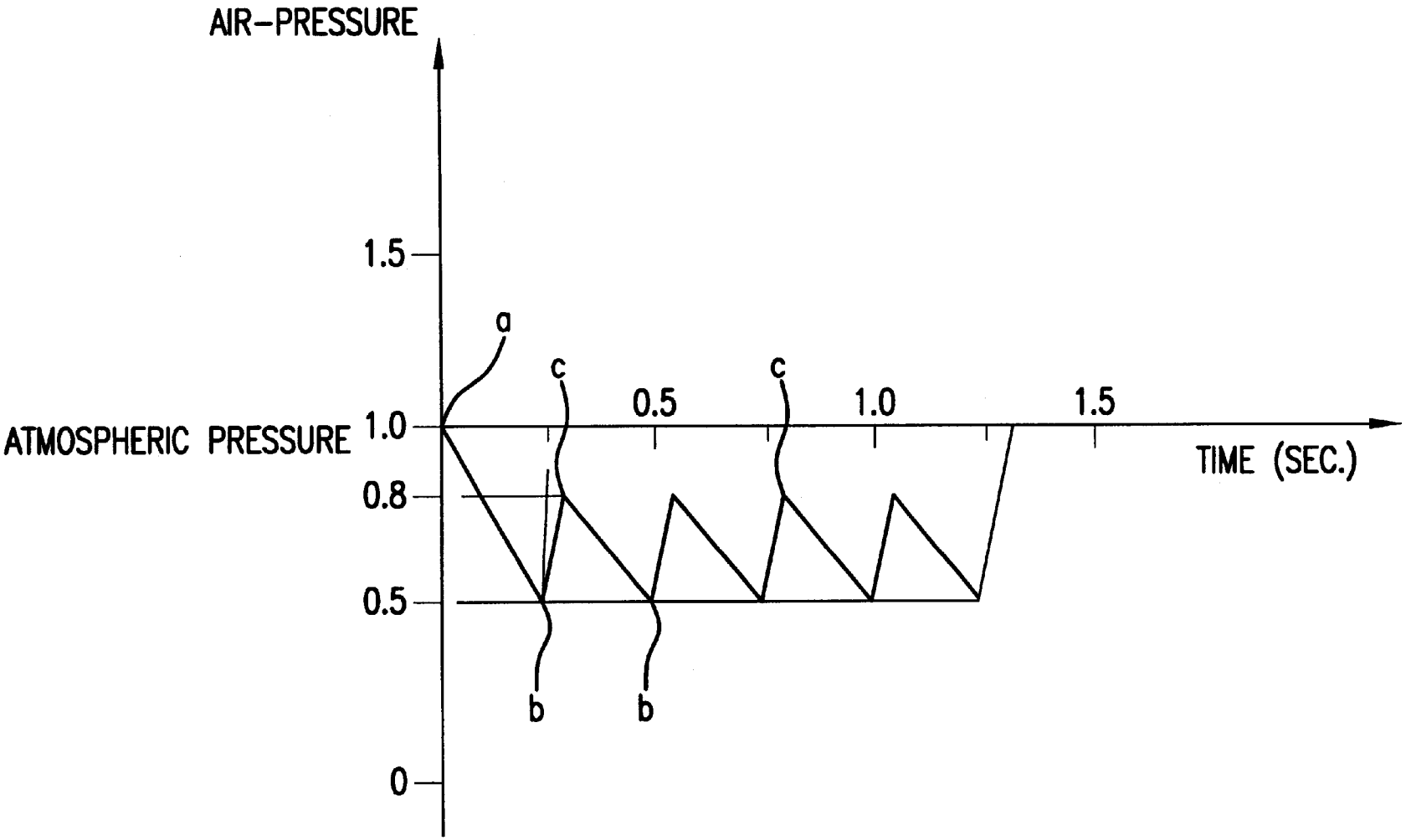
FIG. 7 is an operational diagram showing switching of the air-pressure when the earlier air tapping is applied.

Similarly to the earlier method, in order to fill the die cavity (3) being formed with the die (1) and the lower punch (2) inserted into said die (1) with the powder (p), the feed shoe (5) mounted on the table (4) is moved by driving the horizontal cylinder (12) so as to move the piston rod **(12*a*) until the feed shoe 5 is located above the die cavity (3) as shown in FIG. 6. Then, the powder (5) stored in the feed shoe (5) falls into the die cavity (3)**.

Subsequently, the electromagnetic valve (9) is opened to supply compressed air from the compressed air supplier (10) into the feed shoe (5) so that the air-pressure inside the feed shoe (5) is brought into an air-pressure state (BO) that is higher than the atmospheric pressure (AO) as shown in FIG. 2 in which said air-pressure state (BO) is 1.3 atm. When the air-pressure supplied from the compressed air supplier (10) into the feed shoe (5) exceeds the tolerance of the pressure-releasing valve (13), the air is released from said pressure-releasing valve (13). Then, the electromagnetic valve (9) is closed so as to stop air supply from the compressed air supplier (10) into the feed shoe, and the air inside the feed shoe (5) at a high air-pressure state (BO) is naturally let out from the air-releasing hole (14), which brings the air-pressure inside the feed shoe (5) down to the atmospheric pressure as indicated by (A1) in FIG. 2. At this point, the electromagnetic valve (9) is again opened so as to supply compressed air from the compressed air supplier (10) into the feed shoe (5), thereby bringing the air-pressure state inside the feed shoe (5) into an air-pressure state (B1) that is higher than the atmospheric pressure indicated by (A1). Similarly to the process described above, when the air-pressure supplied from the compressed air supplier (10) into the feed shoe (5) exceeds the tolerance of the pressure-releasing valve (13), the air is released from said pressure-releasing valve (13). Then, the electromagnetic valve (9) is closed so as to stop air supply from the compressed air supplier (10) into the feed shoe, and the air inside the feed shoe (5) at a high air-pressure state (B1) is naturally let out from the air-releasing hole (14), which brings the air-pressure inside the feed shoe (5) down to the atmospheric pressure as indicated by (A2) in FIG. 2.

As discussed so far, by the repetition of air tapping in which the state of air-pressure inside the feed shoe is switched from a state higher than the atmospheric pressure to a state that equals to the atmospheric pressure, the powder (p) can be packed homogeneously and highly densified into the die cavity (3) formed with the die (1) and the lower punch (2) inserted therein. After the powder (p) is packed into the die cavity (3), the horizontal cylinder (12) is moved so as to retract the piston rod **(12*a*), thereby relocating the feed shoe (5) away from the die cavity (3). Then, an upper punch (not shown in the Figure) is inserted into the die (1) and lowered to press the powder (p) packed in the die cavity (3)** so as to obtain a powder compact.

In this embodiment, air tapping is carried out by repetition of switching the air-pressure state from a state higher than the atmospheric pressure to a state of the atmospheric pressure so that air outside the die cavity (3) is not allowed to get into the die cavity (3) through the clearance between the internal wall **(1*b*) of the die and external wall (2*a*) of the lower punch (2)**. Therefore, the problem that the powder (p) is blown up by the air may be prevented from occurring. In addition, air tapping may be carried out by appropriate times of repetition of switching the air-pressure state from a state higher than the atmospheric pressure (higher state) to a state lower than said higher state but yet higher than the atmospheric pressure.

It is also possible to employ an electromagnetic valve instead of the pressure-releasing valve (13), and spare the air-releasing hole (14) provided in the receded part **5*a* of the feed shoe (5). In this case, the air supplied from the compressed air supplier (10) is let out by opening the electromagnetic valve as a substitute for the air-releasing hole (14) so that the air-pressure inside the feed shoe (5**) is brought back to the atmospheric pressure.

As discussed above, by carrying out the air tapping process using air-pressure higher than the atmospheric pressure surrounding the die (1) and the lower punch (2), air is not allowed to get into the die cavity (3) from the clearance between the internal wall (1*b*) of the die (1) and the external wall (2*b*) of the lower punch (2). Therefore, the problem that the powder (p) is blown up does not arise.

Figure 3:
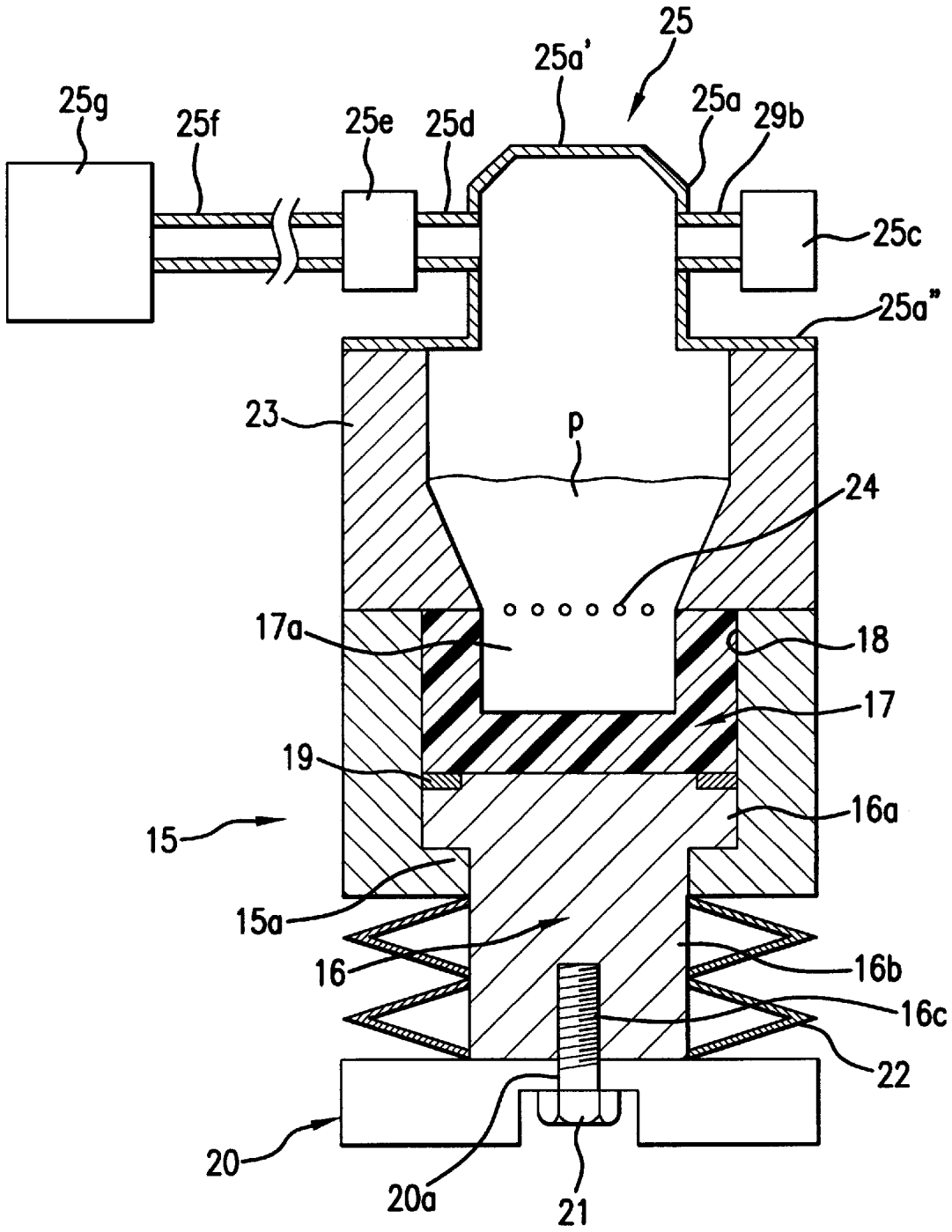
FIG. 3 is a vertical sectional view of another packing apparatus embodying the present invention.

Referring to FIG. 3, an embodiment of the present invention in which the apparatus comprises a rubber mold with a cavity is now described.

A lower punch (16) is inserted into a cylindrical die (15). The lower punch (2) comprises a part with a larger diameter and a part with a smaller diameter. Into the boundary part of these parts, an inwardly protruded part of the die (15*a*) is fit so as to prevent the die (15) from sliding upward.

A rubber mold (17) is placed in a space (18) formed with the internal wall of the die (15) and the external wall of the lower punch (16). The outer diameter of the rubber mold (17) is sized approximately the same as the inner diameter of the die (15). A backup ring (19) made of hard synthetic resin is fit into the upper edge of the lower punch (16) so as to prevent the rubber mold being caught between the die (15) and the lower punch (16). The lower punch (16) is fixed on a support table (20) with a bolt (21) inserted into a hole (20*a*) provided in the support table (20) so that the bolt (21) is fit into a bolthole (16*c*) in the bottom of the lower punch (16). The lower part of the lower punch (16) has a smaller diameter than other parts in which a part (16*b*) is provided with some flat springs being inserted between the bottom surface of the die (15) and the upper surface of the support table (20). The top surface of the rubber mold (17) is designed to nearly be flush with the top surface of the die (15).

A cylindrical guide element (23) is mounted on the top surfaces of the rubber mold (17) and die (15). The bottom opening of the cylindrical guide (23) is provided with a grid element (24) comprising parallel wires, a mesh, a plate with many holes, or the like. Regarding this grid element, the present applicants have disclosed in a patent application, KOKAIH-11-90694, therefore, only a brief explanation will be made here. The powder (p) is injected into the cavity (17*a*) of the rubber mold (17) through the grid element (24) while the air tapping process is carried out. After completion of the air tapping process, the guide element is lifted from the surfaces of the rubber mold (17) and the die (15), when the grid element (24) functions to prevent the powder (p) in the cylindrical guide element (23) from falling off.

The part denoted by (25) is an air-tapping device which comprises a body comprising a cylindrical part (25*a*′) which has an opening bottom and a closed top, and a part horizontally protruding from the lower part of the cylindrical part (25*a*′), further comprising a first electromagnetic valve (25*c*) connected to the cylindrical part (25*a*′) through a pipe (25*d*), a second electromagnetic valve (25*e*) connected to a compressed air supplier (25*g*) through a pipe (25*f*).

The process in which the cavity (17*a*) of the rubber mold (17) is packed with a powder is now described.

The cylindrical guide element (23) loaded with the powder (p) is mounted on the top surfaces of the rubber mold (17) and the die (15), and the air-tapping device (25) is mounted on the top of the cylindrical guide element. With both the first electromagnetic valve (25*c*) and second electromagnetic valve (25*e*) closed, the compressed air supplier (25*g*) is energized. Then, the second electromagnetic valve (25*e*) is opened to send compressed air into the cylindrical guide element (23) from the compressed air supplier (25*g*) so that the inside of the cylindrical guide element (23) becomes to be a high air-pressure state that is higher than the atmospheric pressure. Subsequently, the second electromagnetic valve (25*e*) is closed and the first electromagnetic valve is opened at the same time so as to exhaust the air in a high air-pressure state and bring the inside of the cylindrical guide element back to the atmospheric-pressure-state. After the inside of the cylindrical guide element becomes equal to the atmospheric pressure, the first electromagnetic valve (25*c*) is closed. Then, the second electromagnetic valve (25*e*) is reopened so as to send compressed air into the cylindrical guide element (23) and bring the inside of the cylindrical guide element (23) into a high air-pressure state that is higher than the atmospheric pressure. Then, again the second electromagnetic valve (25*e*) is closed and the first electromagnetic valve (25*c*) is opened to let out the air at a high air-pressure state and bring the inside of the cylindrical guide element (23) back into the atmospheric-pressure-state, and then the first electromagnetic valve (25*c*) is closed. Through this air tapping process, the powder (p) in the cylindrical guide element (23) is injected through the grid element (24) into the cavity (17*a*) of the rubber mold (17).

After the powder is packed into the cavity (17*a*) of the rubber mold (17) by air tapping, the cylindrical guide element (23) and the air-tapping device (25) are detached and an upper punch which is not shown in the Figure is mounted on the top surfaces of the rubber mold (17) and die (15), and lowered. While the upper punch is being lowered, the die (15) is pressed down resisting the elasticity of the flat springs provided between the die (15) and the support table (20). Since the lower punch (16) supported by the support table (20) does not descend, the depth of the space formed with the inner wall of the die (15) and the upper surface of the lower punch (16) is reduced so as to allow the rubber mold (17) to shrink inwardly compressing the powder (p) packed inside the rubber mold (17), thereby producing a powder compact.

In the earlier packing method, the air tapping process was carried out by switching the air-pressure state inside the cylindrical guide element (23) from a state lower than the atmospheric pressure (b) to a state higher than said state (c) alternately. In that case, when the air-pressure state inside the cylindrical guide element (23) and the cavity (17*a*) of the rubber mold (17) became to be lower than the atmospheric pressure, the atmospheric air existing between the external wall of the rubber mold (17) and the internal wall of the die (15) pushed the rubber mold (17), deforming the rubber mold (17) inwardly. In the present invention, because the air tapping process is carried out by switching the air-pressure state inside the cylindrical guide element (23) from a state higher than the atmospheric pressure to a state equal to the atmospheric state alternately, the external wall of the rubber mold (17) is pressed toward the internal wall of the die (15) when the air-pressure state inside the cylindrical guide element (23) and the cavity (17*a*) becomes higher than the atmospheric pressure. Deformation of the rubber mold (17) therefore does not occur, and the desired powder compact may be obtained in this invention.

As discussed so far, the earlier air tapping process by switching the air-pressure state inside the cylindrical guide element (23) from a state lower than the atmospheric pressure (state b) to a state higher than said state (state c) caused the rubber mold (17) to deform inwardly when the air-pressure state inside the cylindrical guide element (23) and the cavity (17*a*) of the rubber mold (17) became lower than the atmospheric pressure (state b). In order to solve this problem, as disclosed in the prior application, KOKAI H-9-78103, the atmospheric air existing between the rubber mold (17) and the die (15) was sucked so that the rubber mold (17) was tightly attached to the die (15) due to the negative pressure generated between the rubber mold (17) and the die (15). However, such a means for generating negative pressure is no longer necessary in this invention in which air tapping is carried out by the repetition of switching the air-pressure state from a state higher than the atmospheric pressure to a state equal to the atmospheric pressure. This serves to simplify the structure of the apparatus.

In addition, unlike the earlier packing method in which the powder (p) was blown up due to the atmospheric air that flowed into the cylindrical guide element (23) through the clearances between the top surfaces of the die (15) and the rubber mold (17) and the bottom surface of the cylindrical guide element (23), the present invention prevents the powder (p) from getting blown up.

Figure 4:
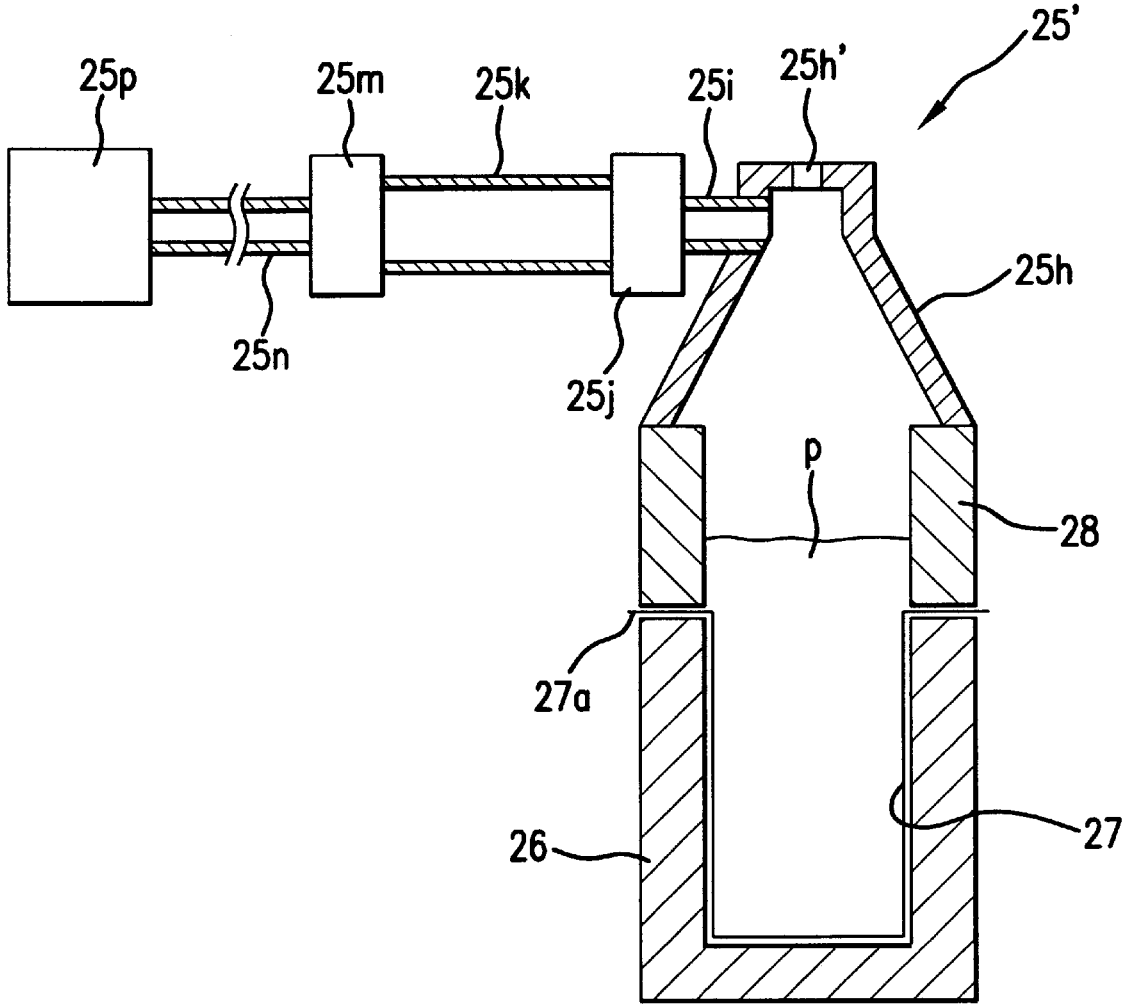
FIG. 4 is a vertical sectional view of another packing apparatus embodying the present invention.
Figure 5:
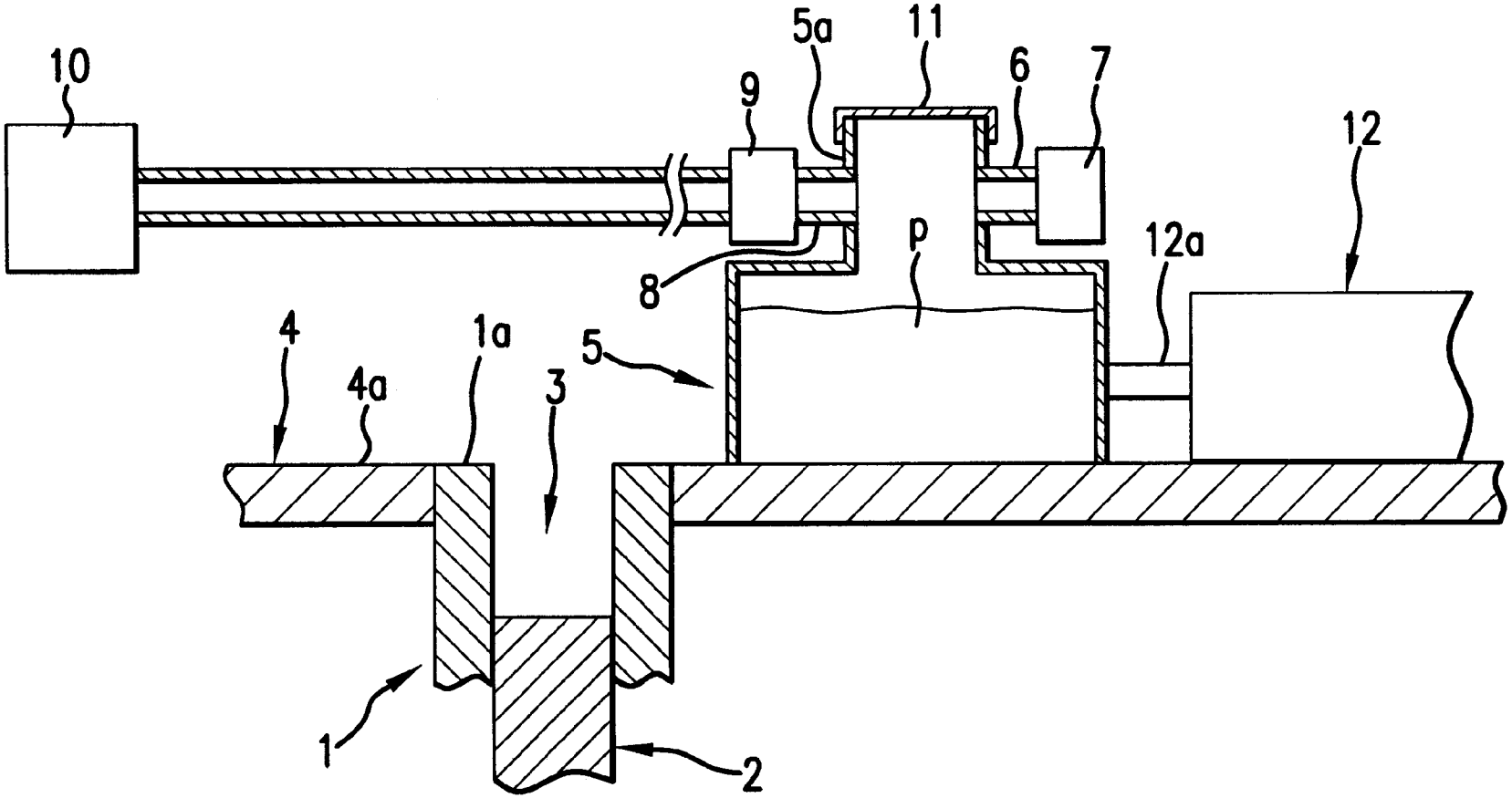
FIG. 5 is a vertical sectional view of a earlier packing apparatus.

An embodiment of the present invention in which a bag is packed with a material such as a powder, a granular material and the like is hereinafter described referring to FIG. 4.

A bag-holding container (26) has an open top, and a bag (27) is set inside the bag-holding container (26). The fringe (27*a*) of the opening of the bag (27) is placed upon the upper surface of the bag-holding container (26). A cylindrical guide element is mounted on the top of the bag-holding container (26).

In this embodiment, an air-tapping device (25') comprises a body (25*h*) comprising an open bottom and a top provided with a penetrating hole (25*h'*), a first electromagnetic valve (25*j*) connected to the side wall of the body (25*h*) through a pipe (25*i*), a second electromagnetic valve (25*m*) connected to the first electromagnetic valve (25*j*) through a pipe (25*k*), and a compressed air supplier (25*p*) connected to the second valve (25*m*) through a pipe (25*n*).

The bag (27) is set inside the bag-holding container (26) so that the fringe of the opening of the bag (27*a*) is placed upon the upper surface of the bag-holding container (26), and the cylindrical guide element (28) is mounted on the upper surface of the bag-holding container (26). Subsequently, a certain amount of the powder (p) is injected to fill the bag (27) and a part of the cylindrical guide element (28). Then, the air-tapping device (25') is mounted so as to cover the top opening of the cylindrical guide element (28).

Subsequently, with the second electromagnetic valve (25*m*) being open and the first electromagnetic valve (25*j*) being closed, the compressed air supplier (25*p*) is energized. The second electromagnetic valve (25*m*) is then closed so that the compressed air having a pressure higher than atmospheric pressure that is supplied from the compressed air supplier (25*p*) is contained in the pipe (25*k*) between the first electromagnetic valve (25*j*) and the second electromagnetic valve (25*m*). Then, the first electromagnetic valve (25*j*) is opened with the second electromagnetic valve (25*m*) being closed so that the air contained in the pipe (25*k*) between the first electromagnetic valve (25*j*) flows into the air-tapping device (25'), which brings the air-pressure state inside the cylindrical guide element (28) into a high air-pressure state that is higher than the atmospheric pressure. Subsequently, the compressed air flowed into the cylindrical guide element (28) is exhausted from the penetrating hole (25*h'*) provided in the top of the body (25*h*), thereby bringing the air-pressure state inside the cylindrical guide element (28) back into the atmospheric pressure state.

By carrying out air tapping by switching the air-pressure state from a high air-pressure state that is higher than the atmospheric pressure to the atmospheric pressure state alternately, the powder (p) that has been injected into the bag (27) as well as the cylindrical guide element (28) is packed into the bag (27).

Similarly to the previous embodiment, air tapping is carried out by switching the air-pressure state from a high air-pressure state that is higher than the atmospheric pressure to the atmospheric pressure state alternately in this embodiment. The powder (p) that has been injected into the bag (27) as well as the cylindrical guide element (28) is therefore packed into the bag (27). The problem that the powder (p) inside the cylindrical guide element (28) is blown up due to inflow of the atmospheric air from the clearance between the bag-holding container (26) and the cylindrical guide element (28) may therefore be prevented from arising.

When the bag (27) is packed with the powder (p) by the earlier packing method in which air tapping is carried out by switching the air-pressure state from a low air-pressure state (b) that is lower than the atmospheric pressure to a high air-pressure state (c) that is higher than said (b) state, a problem arises when the air-pressure state inside the cylindrical guide element (28) and the bag (27) become to be a low air-pressure state (b) that is lower than the atmospheric pressure. That is, the bag (27) deforms inwardly due to inflow of the atmospheric air existing between the bag (27) and the bag-holding container (26). Since the present invention allows the bag (27) to be closely attached to the inner wall of the bag-holding container (26) by adopting air tapping in which the air-pressure state is alternately switched from a high air-pressure state that is higher than the atmospheric pressure to the atmospheric pressure state, deformation of the bag (27) does not occur.

As discussed above, the present invention allows the material to be packed into the container uniformly. This effect may be achieved also by the following process: the container has been preliminarily loaded with a material by the use of another packing method or the earlier packing method, and covered with a shoe that has the same structure as the feed shoe described above, but is not loaded with the material to be packed (hereinafter this shoe is referred to as the "cover shoe"). Then, the cover shoe is subjected to the cycle in which the air pressure state inside the cover shoe is switched from a high air-pressure stated to a low air-pressure state, while keeping the air-pressure higher than or equal to the air-pressure outside the container (normally, atmospheric pressure). The material is therefore packed uniformly into the container throughout with little scattering of the packing quantity at each time of packing. Although this process is disadvantageous in terms of productivity compared with the method in which feeding and packing are carried out simultaneously by the use of the feed shoe that is previously loaded with the material, the air tapping method by the use of the cover shoe is preferably employed in the cases such as the following example:

When a container with a complex shape or a shallow ring shape needs to be filled with a powder with highly controlled weight and dimensional precision, the powder is preliminarily weighed with a high-precision weighing device according to the desired quantity to be filled into a die cavity and fed into the die cavity. At this stage, the packing density in the die cavity is quite uneven. Then the cover shoe is mounted on the top opening of the die cavity and subjected to the air tapping process. This process allows the powder to be filled into every corner of the complicatedly shaped die cavity or circumferential wall of the shallow-ring-shaped cavity with a great homogeneity as well as great weight precision. Unlike the earlier air tapping method in which the quantity of the packed powder may change due to the blowing up of the powder, the air tapping method of the present invention does not change the quantity of the powder at all. Therefore, complicatedly shaped or shallow-ring-shaped powder compacts whose weights and shapes are precisely controlled may be produced by the present invention.

If the material to be packed is a flammable powder or the like, the air used for air tapping may be an inert gas such as nitrogen gas or argon gas. The air that has been referred to in the embodiments above is not limited to the atmospheric air, but comprises inert gases including nitrogen gas and argon gas.

Being constructed as described so far, the present invention has the following effects.

The problem that the material to be packed in the space is blown up by the inflow of the atmospheric air outside the space does not arise, because the air tapping process is carried out by keeping the air-pressure state higher or equal to the atmospheric pressure state.

The apparatus of this invention does not require a means for preventing the container from deforming because the air tapping process is carried out by keeping the air-pressure state higher or equal to the atmospheric pressure state. The structure of the apparatus may therefore be simplified.

We claim:

1. A packing method for packing a material into a container by an air tapping process, comprising:

packing the material into the container by alternately switching an air-pressure state of a space in which the container is located and an air pressure state of a space part connecting with the container, the space being loaded with the material, from a low air-pressure state to a high air-pressure state, wherein the low air-pressure state is at a pressure equal to or higher than an ambient pressure outside of the space.

2. A packing method, comprising:

connecting a feed shoe loaded with a material to be packed with a container comprising a cavity which is to be packed with the material; and packing the material into the container by subjecting the loaded feed shoe to an air tapping process in which an air-pressure state inside the feed shoe is alternately switched a plurality of times from a low air-pressure state to a high air-pressure state, while keeping the low air-pressure state at a pressure equal to or higher than an ambient pressure in a space outside of the container.

3. A packing method, comprising:

mounting a cover shoe on a container comprising a cavity into which a material has previously been fed; and packing the material into the container by subjecting the cover shoe to an air tapping process in which an air-pressure state inside the cover shoe is alternately switched a plurality of times from a low air-pressure state to a high air-pressure state, while keeping the low air-pressure state at a pressure equal to or higher than an ambient pressure in a space outside of the container.

4. An apparatus for homogeneous packing of a material into a container, comprising:

a feed shoe configured to temporarily store the material to be packed into the container and to cover an opening of the container;

means attached to the feed shoe for bringing an air-pressure state inside the feed shoe into a high air-pressure state that is higher than an ambient pressure in a space outside of the container; and means attached to the feed shoe for bringing the air-pressure state inside the feed shoe into a low air-pressure state that is lower than the high air-pressure state, but equal to or higher than the ambient pressure in the space outside of the container.

5. An apparatus for homogeneous packing of a material into a container, comprising:

a cover shoe configured to cover an opening of a container and to contain a powder to be packed into the container;

means attached to the cover shoe for bringing the air-pressure state inside the cover shoe into a high air-pressure state that is higher than an ambient pressure in a space outside of the container; and means attached to the cover shoe for bringing the air-pressure state inside the cover shoe into a low air-pressure state that is lower than said high air-pressure state, but equal to or higher than the ambient pressure space outside the container.

* * * * *